US008857296B2

(12) United States Patent
Huang

(10) Patent No.: US 8,857,296 B2
(45) Date of Patent: Oct. 14, 2014

(54) RATCHET WRENCH BODY AND MANUFACTURING METHOD THEREOF

(76) Inventor: Ping-Chung Huang, Taichung (TW)

( * ) Notice: Subject to any disclaimer, the term of this patent is extended or adjusted under 35 U.S.C. 154(b) by 723 days.

(21) Appl. No.: 13/076,538

(22) Filed: Mar. 31, 2011

(65) Prior Publication Data

US 2012/0247278 A1 Oct. 4, 2012

(51) Int. Cl.

| | |
|---|---|
| ***B25B 13/46*** | (2006.01) |
| ***B22D 25/02*** | (2006.01) |
| ***B22C 9/06*** | (2006.01) |
| ***B22D 17/24*** | (2006.01) |
| ***B22C 9/10*** | (2006.01) |

(52) U.S. Cl.

CPC ..... *B25B 13/463* (2013.01); *B22D 25/02* (2013.01); *B25D 13/56* (2013.01); *B22C 9/06* (2013.01); *B22D 17/24* (2013.01); *B22C 9/101* (2013.01)

USPC ..... 81/60; 81/61; 81/63; 81/63.2

(58) Field of Classification Search

USPC ..... 81/60, 61, 63, 63.2

See application file for complete search history.

(56) References Cited

U.S. PATENT DOCUMENTS

| | | | | |
|---|---|---|---|---|
| 6,382,052 | B1 * | 5/2002 | Chen | 81/63 |
| 7,089,830 | B2 * | 8/2006 | Hu | 81/63.1 |
| 2013/0047791 | A1 * | 2/2013 | Hsu | 81/63.2 |

* cited by examiner

*Primary Examiner* — Lee D Wilson
*Assistant Examiner* — Shantese McDonald
(74) *Attorney, Agent, or Firm* — Rosenberg, Klein & Lee

(57) ABSTRACT

In a ratchet wrench body and its manufacturing method, the body comprises a handle and a head, and the head has a through hole, a control compartment, and a slot chamber. The head has a first surface and a second surface, and at least one embedded hole formed between the slot chamber and the first and second surfaces, and each embedded hole is penetrated through one side but not penetrated through the other side, and each embedded hole is smaller than an elastic element and a propping element contained in the slot chamber, and the slot chamber is extended from each embedded hole inwardly towards the slot chamber and formed by the total volume occupied by adjacent intersected surfaces.

7 Claims, 10 Drawing Sheets

RATCHET WRENCH BODY AND MANUFACTURING METHOD THEREOF

BACKGROUND OF THE INVENTION (a) Field of the Invention

The present invention relates to a ratchet wrench, in particular to the structure of a ratchet wrench body and a manufacturing method of the ratchet wrench body.

(b) Description of the Related Art

With reference to FIGS. 9 and 10 for two types of conventional ratchet wrench bodies 8, 9 respectively, a through hole 80, 90 is formed at an end of each ratchet wrench body 8, 9 separately for containing and installing a ratchet, and a chamber 81, 91 is formed adjacent to the through hole 80, 90 for containing a block brake, and a slot chamber 82, 92 is formed deeply at an internal side of the chamber 81, 91 for containing a propping element and an elastic element.

In the first type of the conventional ratchet wrench body 8, the slot chamber 82 is formed by drilling an end of the ratchet wrench body 8 horizontally by using a drill 8 as shown in FIG. 9, but such manufacturing method will leave a hole 84 at the end of the ratchet wrench body 8 and this hole 84 must be filled after the manufacture is completed. Furthermore, this hole 84 will damage the structure of the ratchet wrench body 8 and result in a lower structural strength of the ratchet wrench body 8, even after the hole 84 is filled.

With reference to FIG. 10 for the second type of the conventional ratchet wrench body 9, the drill 93 is put slantingly into the through hole 90 to drill and form the slot chamber 92, and thus the slot chamber 92 is inclined with respect to the ratchet wrench body 9. Although this manufacturing method will not leave any hole to damage the ratchet wrench body 8, the level of difficulty for drilling the hole is relatively high, particularly when the thickness of the ratchet wrench body 8 is thin. Since the slot chamber 92 for containing the propping element and the elastic element is aslant, the propping element pressed by the elastic element also presses against the block brake slantingly, and the propping element will end up with an insufficient propping force. As a result, it is difficult to push the propping element.

After the slot chambers 82, 92 of the aforementioned two ratchet wrench bodies 8, 9 are formed, impurities may remain in the slot chambers 82, 92 easily during the manufacturing process. Even worse, the slot chambers 82, 92 are disposed at relatively concealed positions. If the elastic element and the propping element are installed before any impurity remained in the slot chambers 82, 92 are cleared, then the propped block brake will be moved unsmoothly, since the impurities remained in the concealed slot chambers 82, 92 cannot be cleaned or removed easily. Obviously, the aforementioned two types of conventional ratchet wrench bodies require improvements.

SUMMARY OF THE INVENTION

Therefore, it is a primary objective of the present invention to overcome the aforementioned problem by providing a ratchet wrench body and a manufacturing method thereof, wherein a slot chamber capable of maintaining the structural strength of the ratchet wrench is formed horizontally on the ratchet wrench, without damaging the structure of a ratchet wrench. When the elastic element and the propping element contained in the slot chamber is propped, the effect of a uniform force exertion can be achieved.

Another objective of the present invention is to provide a convenient way of washing the impurities away from the slot chamber by rinsing water through the embedded hole on the ratchet wrench.

To achieve the foregoing objective, the ratchet wrench body of the present invention comprises:

a handle of a ratchet wrench, and a head formed at an end of the handle and having two opposite flat surfaces such as a first surface and a second surface respectively, a through hole penetrated through the head, and both ends of the through hole being hollow with respect to the first surface and the second surface for containing the ratchet, and the head having a control compartment formed between the first surface and the second surface for containing a block brake provided for braking the ratchet, and the control compartment being interconnected to a side of the through hole facing towards the handle, and also interconnected to the slot chamber, and the slot chamber being disposed on another side of the through hole opposite to the control compartment and orthogonally intersected with the through hole for containing the elastic element and the propping element that prop the block brake, and at least one embedded hole being formed between the first surface and the second surface, and each embedded hole being passed from one side without penetrating the other side, and each embedded hole being smaller than the elastic element and the propping element contained in the slot chamber, and the slot chamber being extended from each embedded hole towards the interior of the slot chamber and formed by total volume of adjacent intersected surfaces.

To achieve the foregoing objectives, the method for manufacturing the slot chamber on the ratchet wrench body in accordance with the present invention takes the following technical measures:

The ratchet wrench body is formed by casting, and a casting mold is provided for setting a slide member at a predetermined position corresponding to each embedded hole before the slot chamber is formed, and after a casting material is shaped in the casting mold, the slide member will be detached together with the removal of the casting mold to form the slot chamber and each embedded hole on the ratchet wrench.

The above and other objectives and advantages of the present invention will be apparent with the detailed description of preferred embodiments and the illustration of related drawings as follows.

Of course, the present invention can adopt other components or other arrangements of components to achieve the same effect, and the embodiments here are provided for demonstrating the present invention, but not intended for limiting the scope of the invention.

DETAILED DESCRIPTION OF THE PREFERRED EMBODIMENTS

With reference to FIGS. 1 to 6 for a first preferred embodiment of the present invention, this preferred embodiment is used for the purpose of illustrating the present invention only, but not intended for limiting the scope of the invention.

Figure 1:
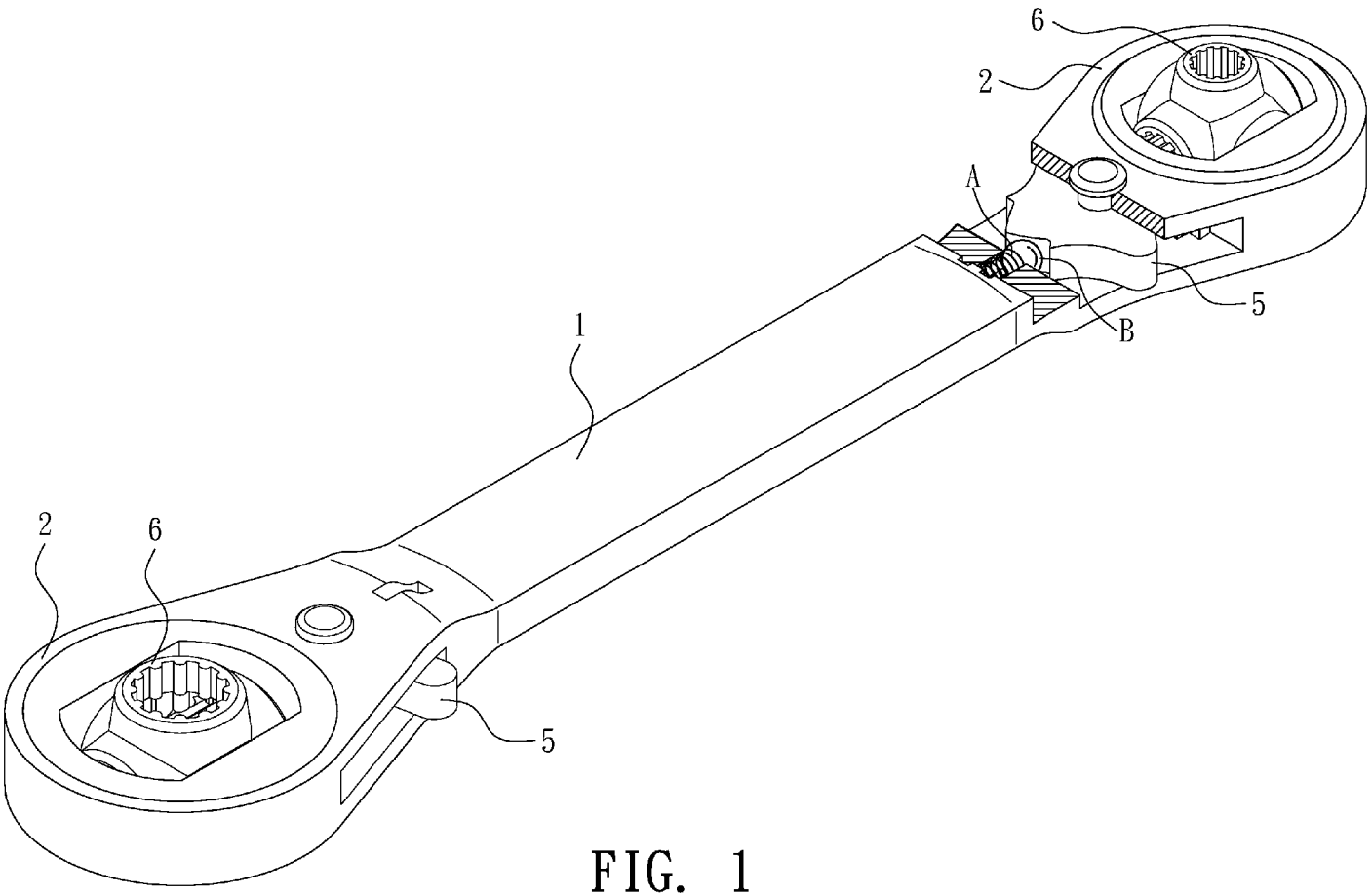
FIG. 1 is a perspective view of a ratchet wrench in accordance with a first preferred embodiment of the present invention.

The present invention provides a structure of a ratchet wrench body, and the structure of the ratchet wrench body can be applied to a unidirectional drive type ratchet wrench or a bidirectional drive type ratchet wrench, and the bidirectional drive type ratchet wrench is used as an example in this preferred embodiment as shown in FIG. 1, wherein the ratchet wrench comprises a handle 1, and a head 2 is disposed separately at both ends of the handle 1, and the handle 1 and the two heads 2 are integrated to form a slotted ratchet wrench, and each of the two heads 2 of this preferred embodiment has a bidirectional driving socket 6 driven by the block brake 5.

Figure 2:
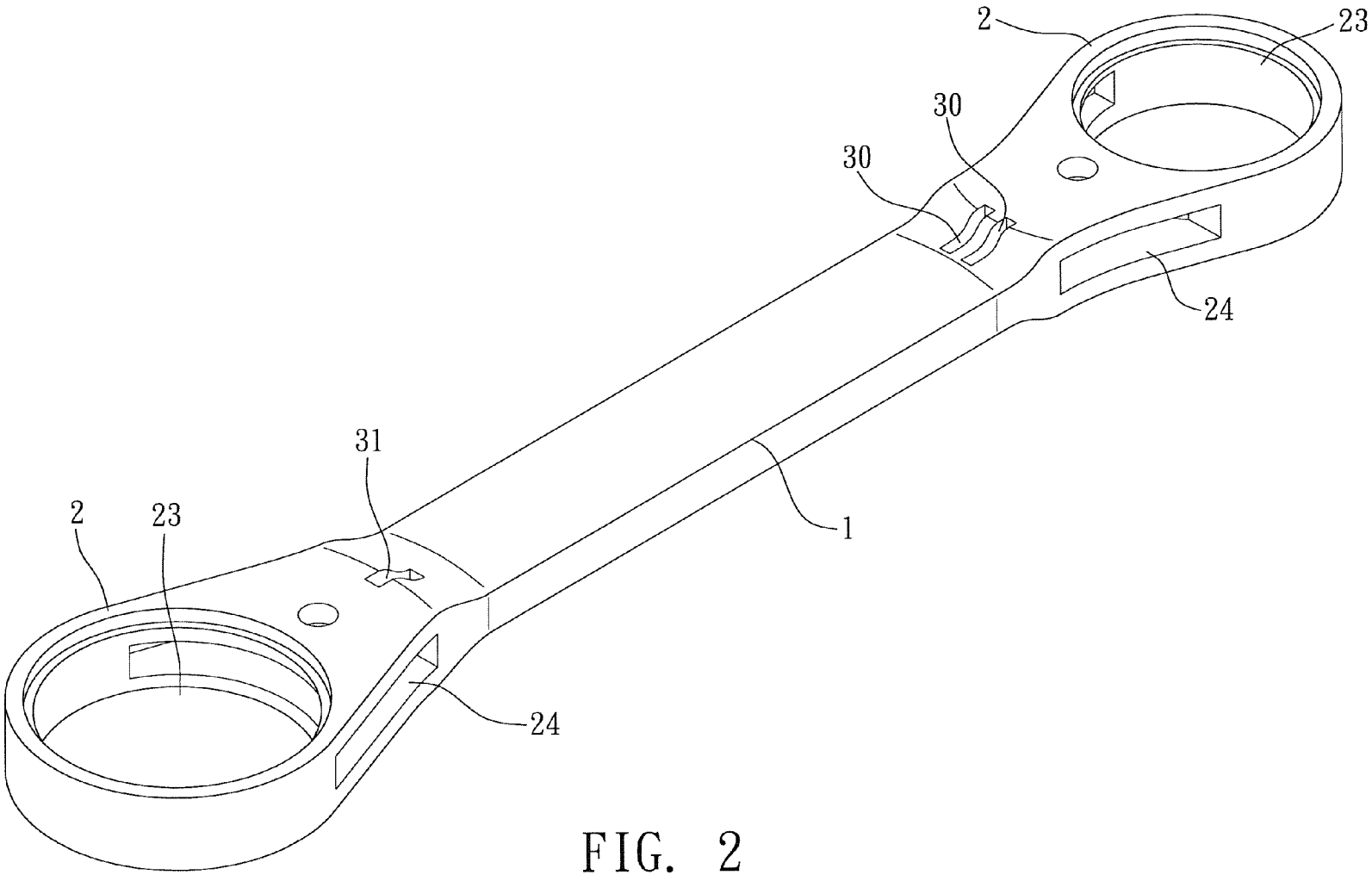
FIG. 2 is a perspective view of a ratchet wrench body in accordance with a first preferred embodiment of the present invention.
Figure 3:
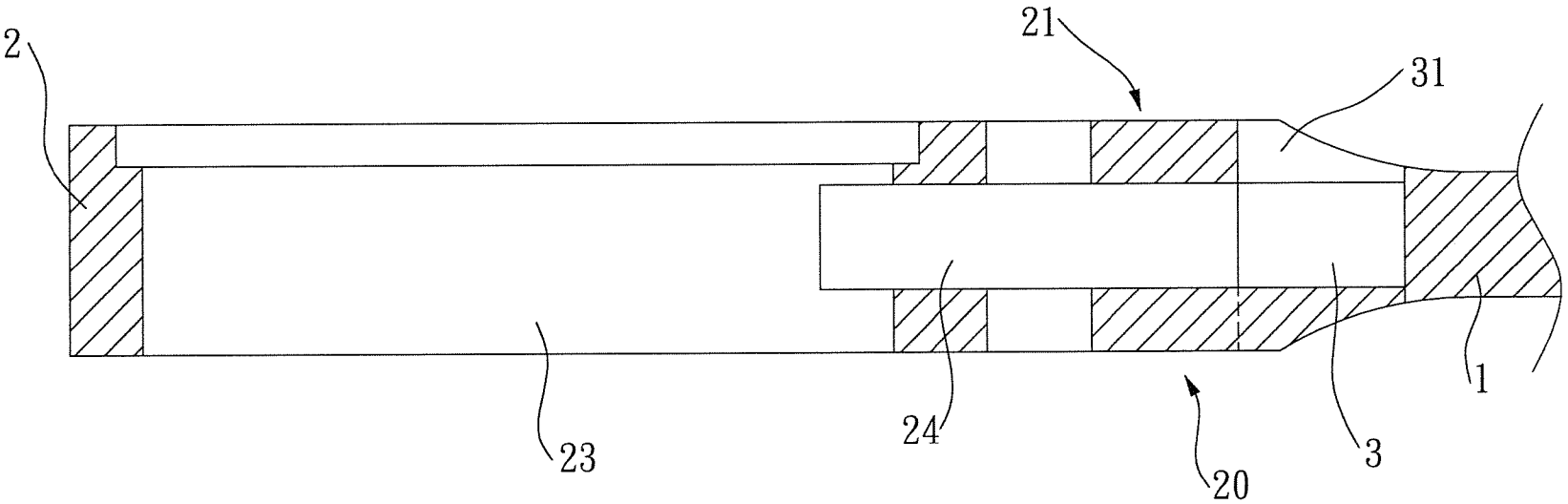
FIG. 3 is a cross-sectional view of a head of a ratchet wrench in accordance with a first preferred embodiment of the present invention.

With reference to FIGS. 2 and 3, the head 2 has two opposite flat surfaces, respectively: a first surface 20 and a second surface 21, and through hole 23 is penetrated through the head 2, and both ends of the through hole 23 are hollow and disposed on the first surface 20 and the second surface 21 respectively for containing a ratchet (not shown in the figure), and the ratchet is provided for driving a driving structure, such that the driving structure can drive a driven component such as a bolt or a nut, wherein the driving structure of this preferred embodiment is the socket 6.

The head 2 has a control compartment 24 formed between the first surface 20 and the second surface 21, and provided for containing the block brake 5, and the block brake 5 contained in the control compartment 24 can be latched by the ratchet in the through hole 23, wherein the control compartment 24 of this preferred embodiment is provided for containing the block brake 5 in a substantially triangular shape. The control compartment 24 is interconnected to the through hole 23 on a side facing towards the handle 1, and the control compartment 24 is also interconnected to a slot chamber 3, and the slot chamber 3 is disposed on another side of the through hole 23 opposite to the control compartment 24, and the slot chamber 3 and the through hole are intersected orthogonally in the axial direction, and the slot chamber 3 is provided for containing the elastic element A and a propping element B that prop the block brake 5.

Figure 4:
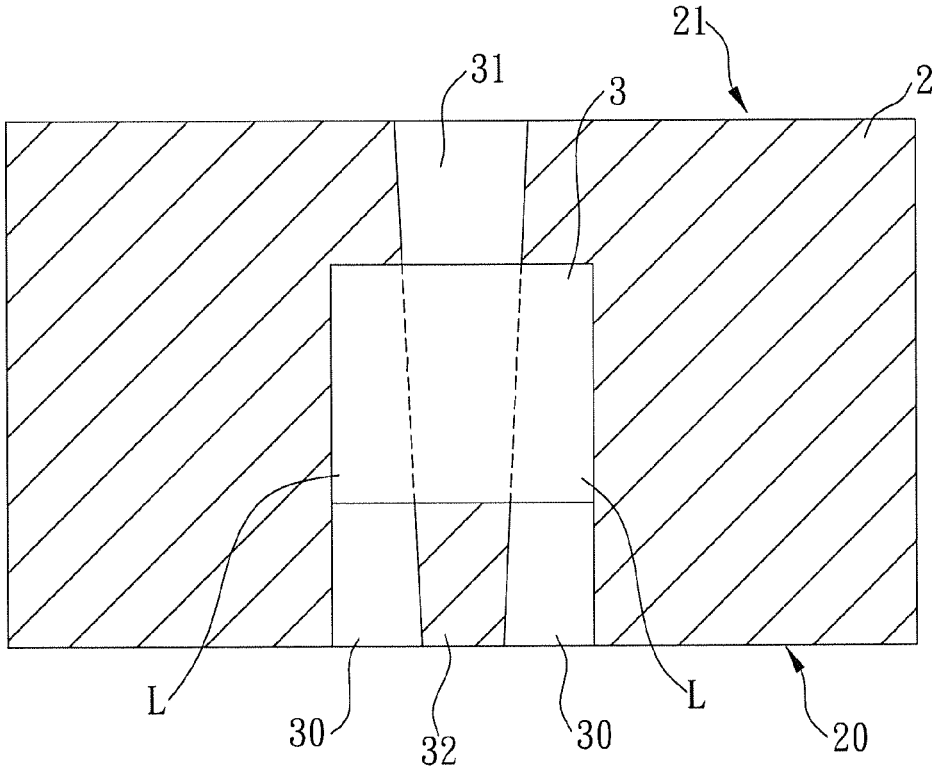
FIG. 4 is a schematic cross-sectional view of a slot chamber in accordance with a first preferred embodiment of the present invention.

In FIG. 4, two embedded holes 30 are formed between the first surface 20 and the slot chamber 3 in this preferred embodiment, and disposed on an external side opposite to the slot chamber 3, and an embedded hole 31 is formed between the second surface 21 and the slot chamber 3, and the embedded hole 31 is disposed on an internal side opposite to the slot chamber 3, and a partition 32 is disposed between the two embedded holes 30.

In FIG. 4, the embedded hole 30 is passed into the first surface 20 from one side without penetrating through the second surface 21 from the other side, and the embedded hole 31 is passed into the second surface 21 from a side without penetrating through the first surface 20 on the other side, and each embedded hole 30, 31 is smaller than the elastic element A and the propping element B contained in the slot chamber 3, and each of the embedded hole 30, 31 has a width tapered from the first surface 20 and second surface 21 towards the slot chamber 3.

Figure 5:
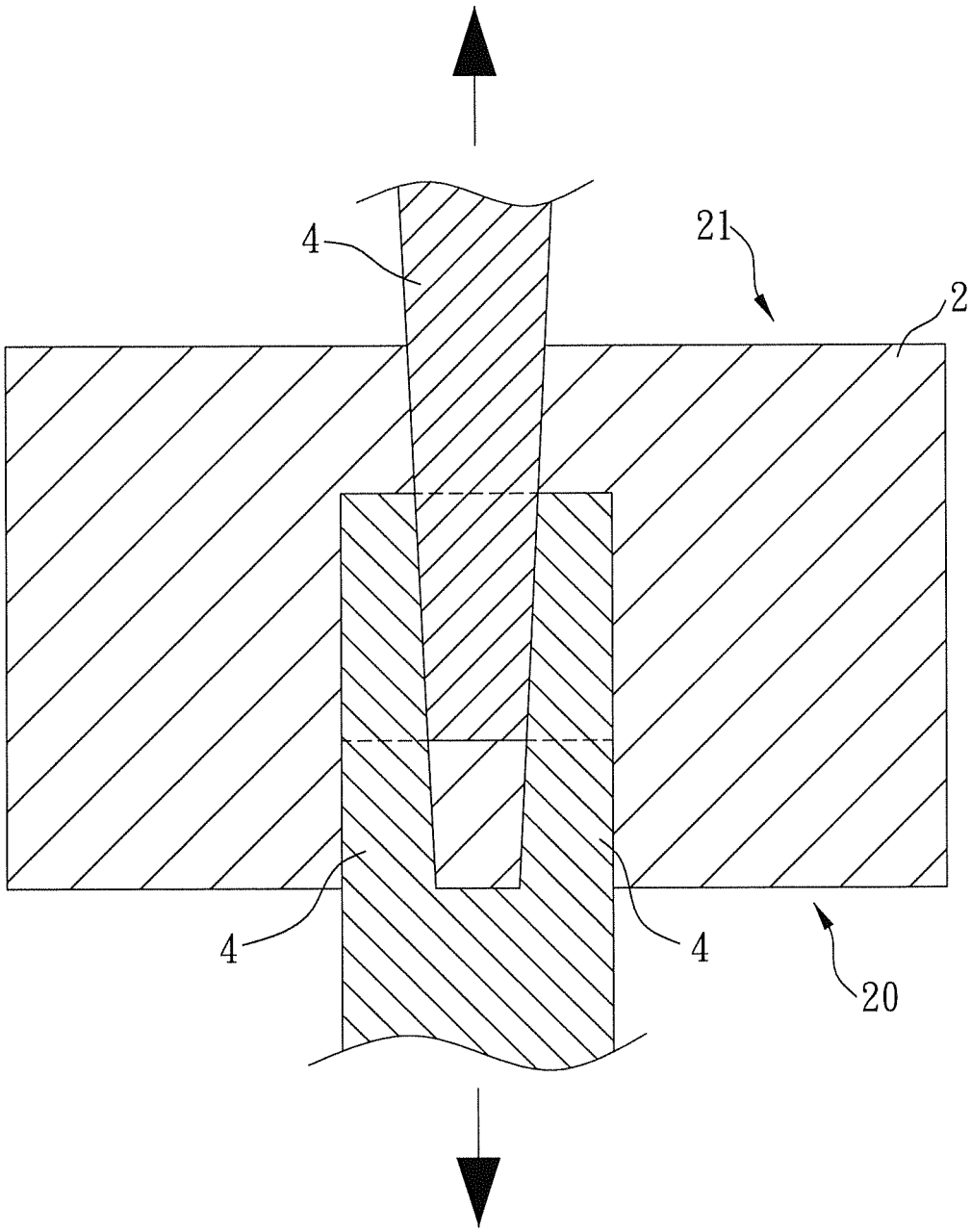
FIG. 5 is a schematic view of forming a slot chamber in accordance with a first preferred embodiment of the present invention.

With FIG. 5 for the method of forming the slot chamber 3 of the ratchet wrench body, a slide member 4 is formed at a predetermined position corresponding to each embedded hole 30, 31 before a casting mold is used for forming the slot chamber 3, since the ratchet wrench body is formed by casting. After a casting material is shaped in the casting mold, the slide member 4 will be detached together with the removal of the casting mold to form the lot chamber 3 and each embedded hole 30, 31 on the ratchet wrench.

In FIG. 4, two virtual lines L are drawn in the slot chamber 3 to represent adjacent surface extended from each embedded hole 30, 31 towards the slot chamber 3. In FIG. 5, the slide members 4 are abutted against with each other, and the two virtual lines are extended along the internal side of the embedded hole 30 and from both sides of the embedded hole 31 in a direction towards the inside of the slot chamber. We can observe that each embedded hole 30, 31 in the slot chamber 3 has an oblique side which constitutes an adjacent side for intersecting with another adjacent side, and the slide members 4 are abutted with each other, such that the casting material cannot enter into the space of the slot chamber for its shaping. The total volume occupied by the intersected adjacent surfaces defines the space of the slot chamber 3.

Obviously, the ratchet wrench body and the manufacturing method of the ratchet wrench in accordance with the present invention have the following advantages:

1. In the process of forming the slot chamber, the ratchet wrench is shaped by casting. In other words, the slot chamber 3 and the embedded holes 30, 31 are formed during the casting process, but not produced in the form of the slot chamber 3 and the embedded hole 30, 31 that may damage the ratchet wrench body of the after the ratchet wrench is formed, such that the ratchet wrench can maintain its predetermined structural strength. In addition, the slot chamber and the through hole are intersected orthogonally in an axial direction, and thus the slot chamber can be formed horizontally on the ratchet wrench, wherein the embedded hole 30, 31 is smaller than the elastic element A and the propping element B contained in the slot chamber 3, and the partition 32 disposed between the two embedded holes 30 is provided for blocking, such that the elastic element A and the propping element B can be limited in the slot chamber 3. Regardless of the configuration of the ratchet wrench having a propping element B contained in the slot chamber 3 and pushed by the elastic element A props the ratchet directly, or props the block brake 5 and then controls the turning direction of the ratchet, the ratchet or the block brake 5 can be pushed by the propping element B to achieve a uniform force exertion effect.

Figure 6:
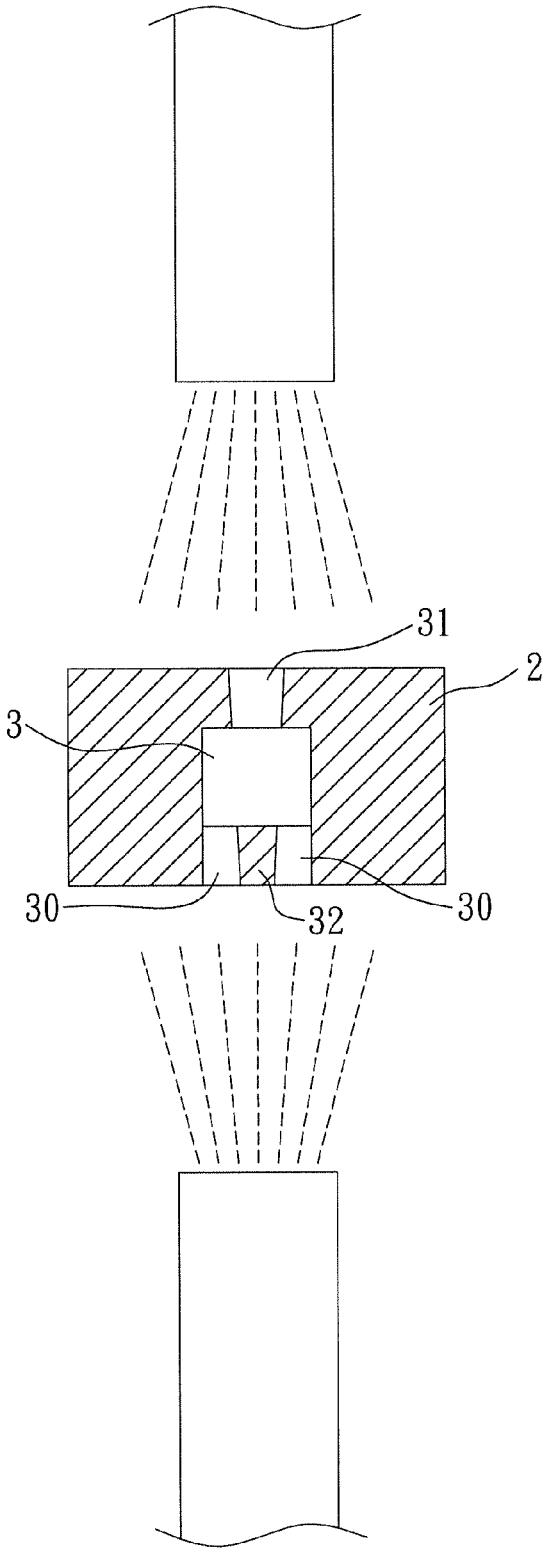
FIG. 6 is a schematic view of washing a slot chamber in accordance with a first preferred embodiment of the present invention.

2. In FIG. 6, if impurities are remained in the slot chamber 3 during the manufacturing process, wherein the ratchet wrench is formed or the elastic element A and propping element B are installed after the slot chamber 3 is formed, oil or clean water can be used directly for rinsing by washing water through the embedded holes 30, 31 into the slot chamber 3 of the ratchet wrench. Besides the direct rinsing method for washing away the impurities in the slot chamber 3, the embedded holes 30, 31 are also provided for the purpose of observing the situation of the impurities in the slot chamber 3 to assure that there is no more impurity in the slot chamber 3, so as to prevent unsmooth operation of the elastic element A and braking element caused by the impurities remained in the slot chamber 3.

Figure 7:
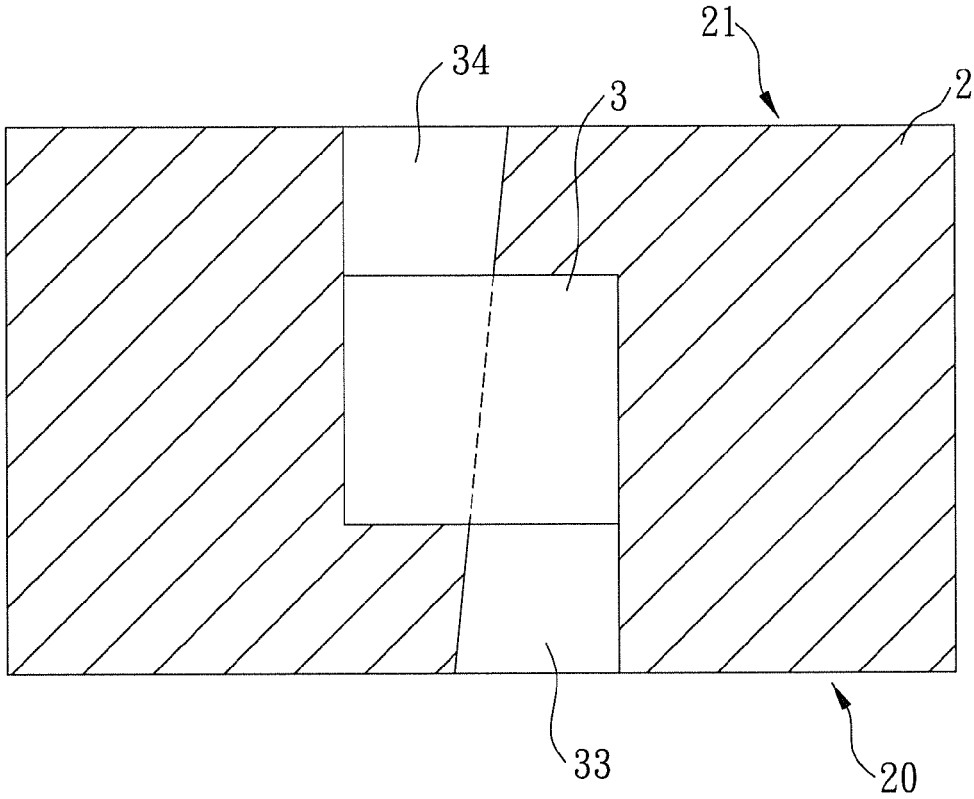
FIG. 7 is a schematic cross-sectional view of a slot chamber in accordance with a second preferred embodiment of the present invention.
Figure 8:
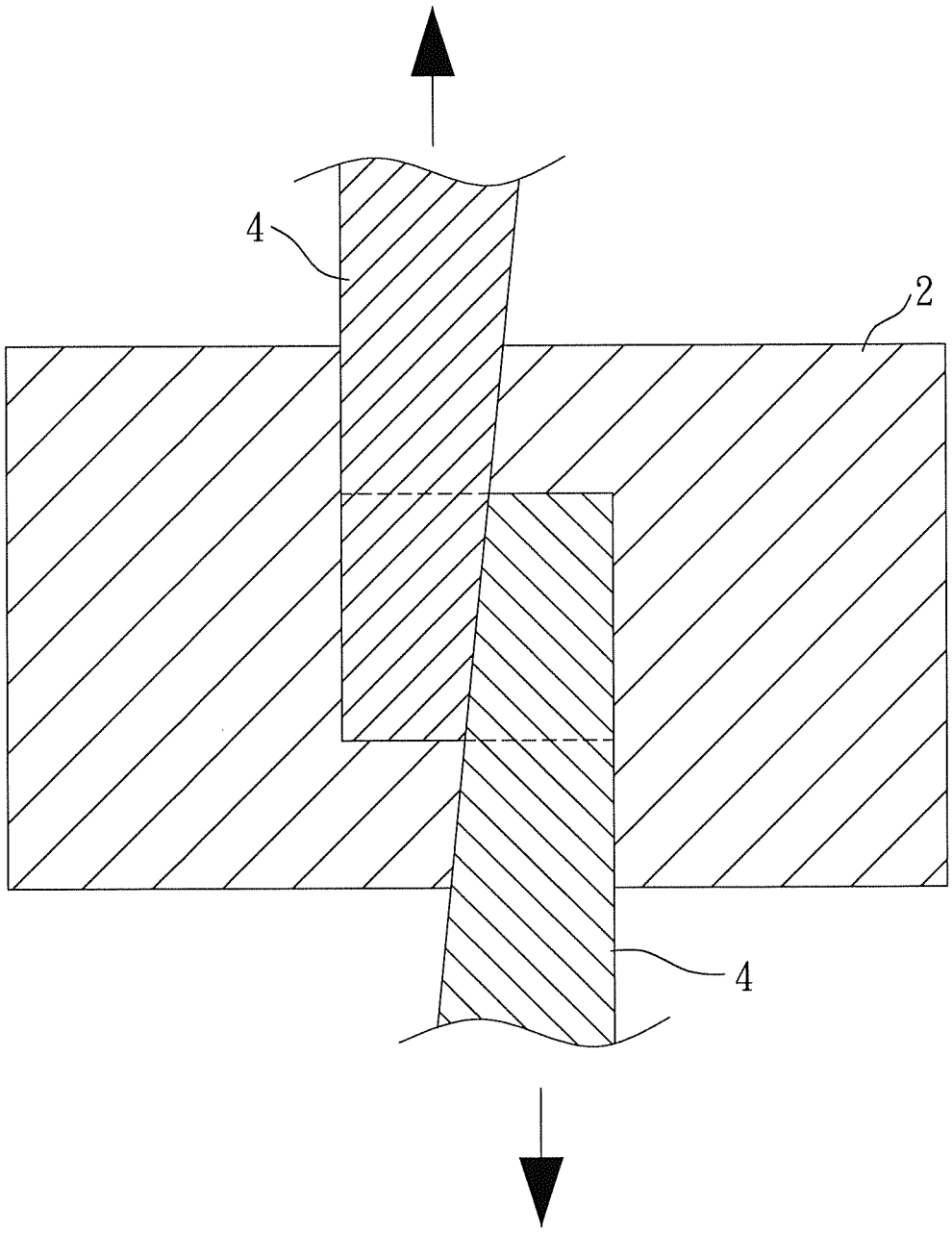
FIG. 8 is a schematic view of forming a slot chamber in accordance with a second preferred embodiment of the present invention.
Figure 9:
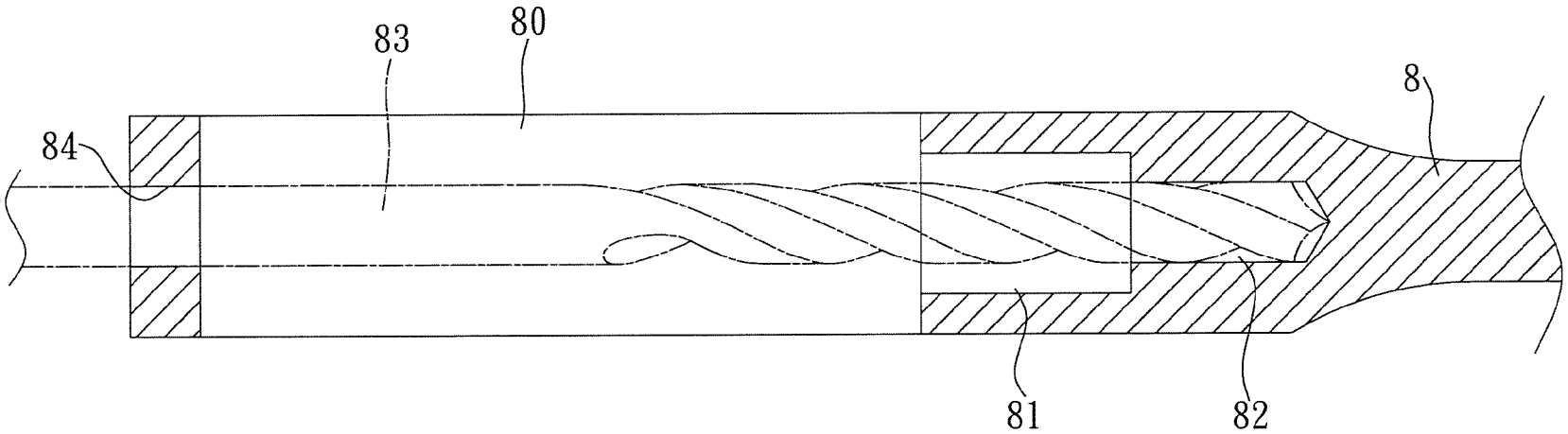
FIG. 9 PRIOR ART
FIG. 9 is a schematic view of a conventional ratchet wrench structure with a drilled slot chamber.
Figure 10:
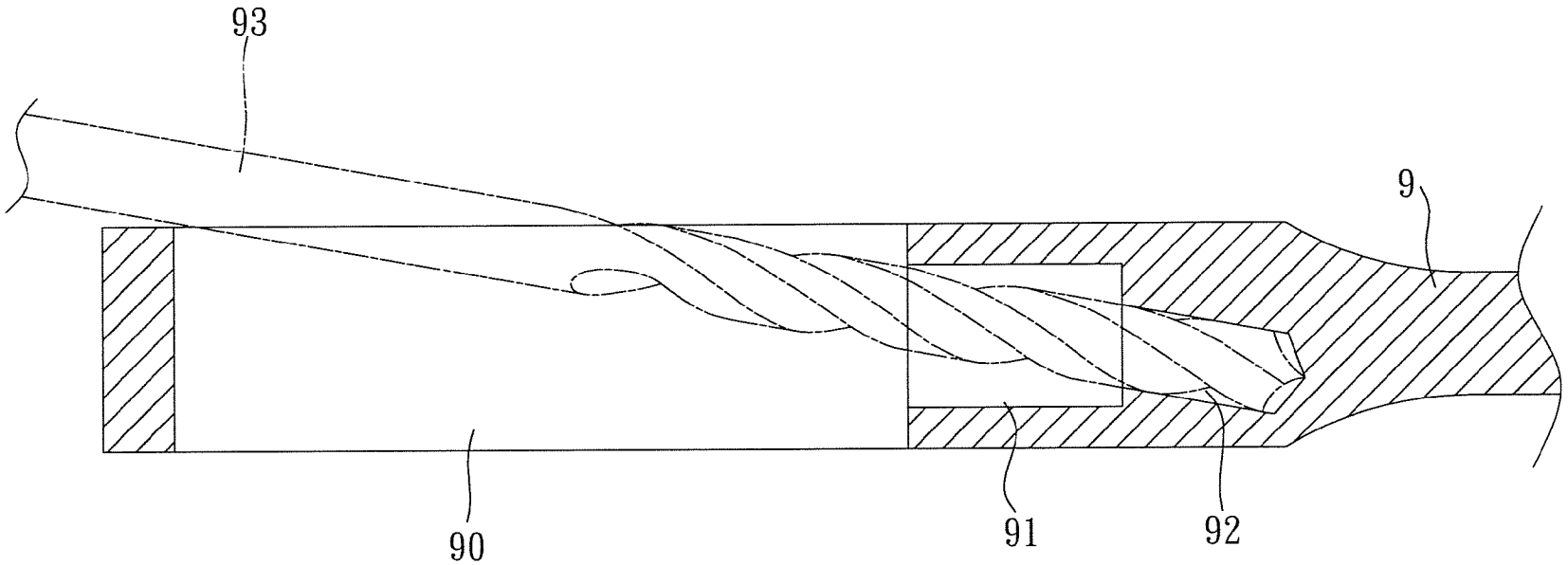
FIG. 10 PRIOR ART
FIG. 10 is a schematic view of another conventional ratchet wrench structure with a drilled slot chamber.

Of course, other embodiments can be adopted in the present invention, and the modifications are simply minor changes. With reference to FIG. 7 for a second preferred embodiment of the present invention, there is only one embedded hole 33 formed between the first surface 20 and the slot chamber 3, and there is only one embedded hole 34 formed between the second surface 21 and the slot chamber 3, and the two embedded holes 33, 34 as shown in FIG. 7 are formed on both sides of the slot chamber 3 respectively. With reference to FIG. 8 for a schematic view of the formed slot chamber 3 in accordance with this preferred embodiment, the two slide members 4 are disposed at predetermined positions of the slot chamber 3 respectively. Similar to the first preferred embodiment, when the casting mold is removed, the slide member 4 is detached together with the casting mold, and the embedded holes 33, 34 are formed on the first surface 20 and the second surface 21 of the ratchet wrench, and the slot chamber 3 is formed in the embedded holes 33, 34, so as to achieve the same effect of the first preferred embodiment.

In addition, the ratchet wrench body of the present invention may have different configurations, such as the head and the handle of the ratchet wrench are pivotally coupled with each other, and the head can be pivotally turned with respect to the handle.

While the invention has been described by means of specific embodiments, numerous modifications and variations could be made thereto by those skilled in the art without departing from the scope and spirit of the invention set forth in the claims.

In summation of the above description, the present invention herein enhances the performance than the conventional structure and further complies with the patent application requirements and is duly filed for patent application.

What is claimed is:

1. A ratchet wrench body, comprising a handle of a ratchet wrench and at least one head disposed at an end of the handle, the head having a first surface and a second surface on opposing sides thereof, a through hole penetrated through the head and hollow between the first surface and the second surface for containing a ratchet, and the head having a control compartment formed between the first surface and the second surface and provided for containing a block brake for braking the ratchet, and the control compartment being interconnected to the through hole on a side facing towards the handle, and the control compartment being interconnected to a slot chamber, and the slot chamber being disposed on the other side of the control compartment without the through hole and disposed orthogonally with the through hole in an axial direction for containing an elastic element and a propping element of the block brake, and at least one embedded hole formed between the first and second surfaces and the slot chamber, and each embedded hole penetrating through only one of the first or second surfaces, each embedded hole being smaller than the elastic element and the propping element contained in the slot chamber, and the slot chamber extending from each embedded hole defining the chamber.

2. The ratchet wrench body of claim 1, wherein each of the embedded holes has a width tapered from the first surface and the second surface towards the slot chamber, such that each embedded hole is intersected by adjacent extended surfaces in the slot chamber.

3. The ratchet wrench body of claim 2, further comprising a pair of embedded holes formed between one of the first and second surfaces and the slot chamber and disposed on external sides with respect to the slot chamber respectively, a partition formed between the pair of embedded holes, and an embedded hole formed between the other one of the first and second surfaces and the slot chamber and disposed on an internal side with respect to the slot chamber.

4. The ratchet wrench body of claim 2, further comprising an embedded hole separately formed between the first surface and the second surface and the slot chamber, and the two embedded holes are disposed on both sides with respect to the slot chamber.

5. The ratchet wrench body of claim 1, applied to a unidirectional drive type ratchet wrench or a bidirectional drive type ratchet wrench.

6. The ratchet wrench body of claim 1, wherein the control compartment is provided for containing a block brake in a form of a triangle steel.

7. The ratchet wrench body of claim 1, wherein the handle and the head are integrally formed or the head and the handle are pivotally coupled to each other.

* * * * *